United States Patent [19]

Kellogg

[11] 4,334,483

[45] Jun. 15, 1982

[54] INTERLOCKING SHELF AND BRACKET CONSTRUCTION

[76] Inventor: Harlan F. Kellogg, 1617 Sprucewood, Rockford, Ill. 61107

[21] Appl. No.: 173,153

[22] Filed: Jul. 28, 1980

[51] Int. Cl.[3] ..... A47B 5/02

[52] U.S. Cl. ..... 108/152; 108/159; 248/250

[58] Field of Search ..... 108/152, 159; 248/235, 248/250, 249

[56] References Cited

U.S. PATENT DOCUMENTS

| | | | |
|---|---|---|---|
| 2,834,478 | 5/1958 | MacDonald | 248/250 |
| 2,900,085 | 8/1959 | Levy | 248/250 |
| 2,975,908 | 3/1961 | Huet | 248/250 |
| 2,993,603 | 7/1961 | Fohn | 108/152 |
| 3,604,670 | 9/1971 | Reeves | 248/250 |
| 4,037,896 | 7/1977 | Kennedy et al. | 108/159 |
| 4,121,801 | 10/1978 | Kellogg | 108/152 |
| 4,181,382 | 1/1980 | Harvey | 108/152 |

*Primary Examiner*—Francis K. Zugel

*Attorney, Agent, or Firm*—Vernon J. Pillote

[57] ABSTRACT

An interlocking shelf and shelf bracket construction in which the shelf brackets have an upper shelf supporting surface and forwardly and rearwardly facing abutment faces extending transverse to the shelf supporting surface, and the shelf has forward and rear abutment strips arranged to engage the forward and rear abutment faces on the shelf brackets. The rear abutment strip is mounted on the shelf to have portions resiliently movable relative to the shelf in a direction away from the forward abutment strip to resiliently clamp first and second abutment faces on the shelf brackets between the first and second abutment strips.

4 Claims, 4 Drawing Figures

Fig. 1
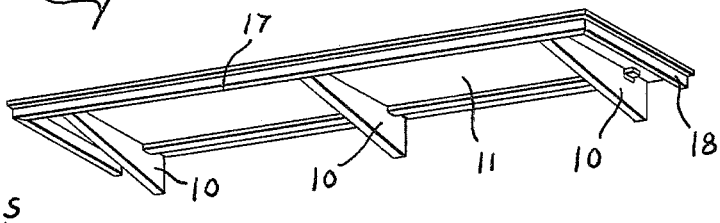
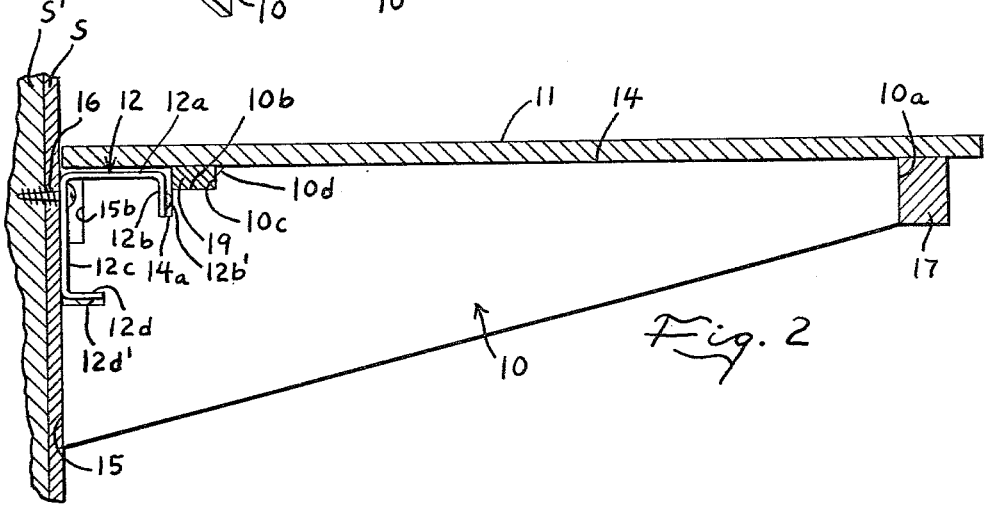
Fig. 2
Fig. 3
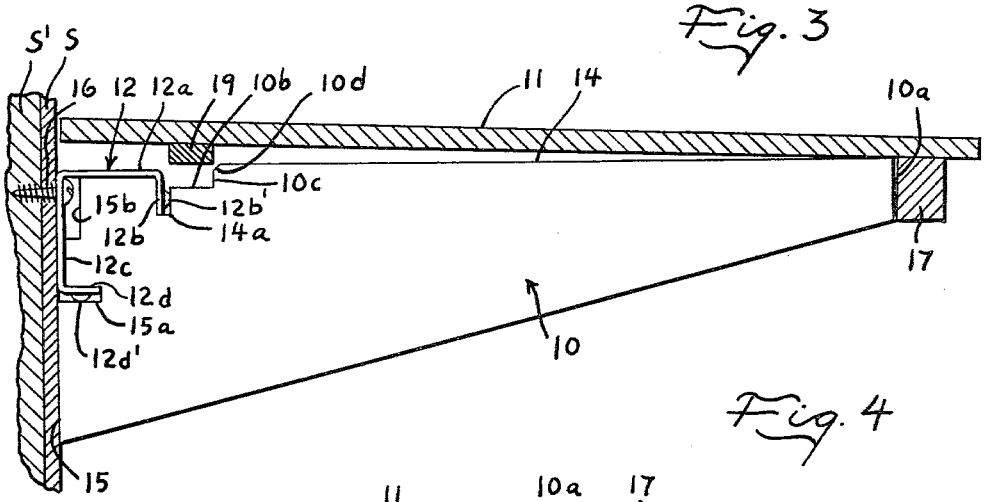
Fig. 4
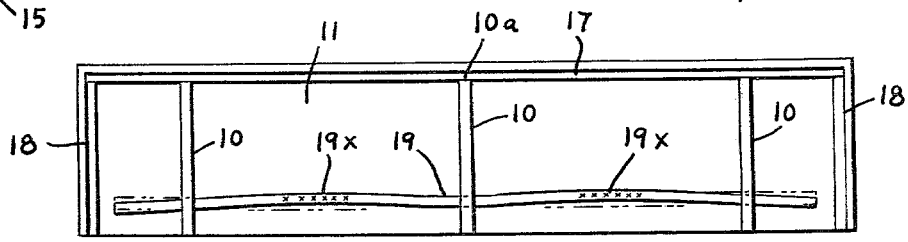

INTERLOCKING SHELF AND BRACKET CONSTRUCTION

BACKGROUND OF THE INVENTION

The present invention relates to shelving in which the shelf brackets are attached at their rear ends to a supporting surface to extend forwardly in cantilever fashion and a shelf is supported on the upper surface of the shelf brackets. It is desirable to anchor the shelf against movement relative to the shelf brackets both in a direction lengthwise of the shelf and in a direction crosswise of the shelf. It has heretofore been proposed, as shown in U.S. Pat. No. 2,900,085, to provide a strip at the underside of the shelf which is receivable in a notch in the shelf bracket, to anchor the shelf against movement crosswise of the shelf along the shelf bracket, and to notch the strip to receive the shelf bracket, to thereby anchor the shelf against lengthwise movement relative to the shelf bracket. With the arrangement disclosed in that patent, the notches in the strip must be at the precise location of the shelf bracket. However, the location and spacing of the shelf brackets frequently varies in different installations and the shelf and shelf bracket construction disclosed in the aforementioned patent is not adapted to accommodate different spacing or positioning of the shelf brackets relative to the shelf.

SUMMARY OF THE INVENTION

It is an object of the present invention to overcome the disadvantages of the prior art by providing interlocking shelf and shelf bracket construction in which the shelf is arranged to interlock with the shelf brackets to prevent lengthwise and crosswise movement of the shelf relative thereto, without requiring positioning of the shelf brackets at precise locations along the length of the shelf.

Accordingly, the present invention provides an interlocking shelf and shelf bracket construction in which the shelf brackets are mounted at their rear ends on a supporting surface and extend forwardly therefrom in cantilever fashion and have an upper shelf supporting surface, the shelf brackets each having a forwardly facing first abutment face extending transverse to the upper shelf supporting surface against the forward end of the shelf bracket and a rearwardly facing second abutment face extending transverse to the upper shelf supporting surface at a location spaced rearwardly of the first abutment face, a shelf overlying the upper shelf supporting surface and having a first abutment strip expending therebelow generally parallel to the forward edge of the shelf for engaging the first abutment face in the shelf bracket, and the shelf having a second abutment strip extending therebelow generally parallel to the first strip for engagement with the second abutment face and spaced from the first abutment means a distance no greater than the minimum spacing between the first and second abutment faces on the shelf bracket, at least one of the abutment strips on the shelf being resiliently movable relative to the shelf in a direction away from the other abutment strip to clamp the first and second abutment faces on the shelf bracket between the first and second abutment strips when the shelf is assembled on the shelf brackets.

The abutment strip on the shelf is attached to the shelf only at locations intermediate the shelf brackets and has portions intermediate the attached locations which are resiliently yieldable to allow relative movement of the first and second abutment strips when the shelf is assembled on the shelf brackets.

These, together with other objects, features and advantages of this invention will become apparent from the following description when considered in connection with the accompanying drawings wherein:

FIG. 1 is a perspective view of the interlocking shelf and shelf bracket construction;

FIG. 2 is a transverse sectional view through the shelf and shelf bracket construction on a larger scale than FIG. 1;

FIG. 3 is a transverse sectional view through the shelf and shelf bracket construction and illustrating assembly of the shelf on the shelf bracket; and FIG. 4 is the bottom view of the shelf and shelf bracket assembly.

The shelving system comprises two or more shelf brackets 10 and a shelf 11 that extends between the shelf brackets and is supported thereby. The shelf brackets 10 are of the type that are mounted at their rear ends on a supporting surface and extend forwardly therefrom in cantilever fashion. In the embodiment shown, the shelf brackets 10 are of the type more fully disclosed in U.S. Pat. No. 4,121,801 issued Oct. 24, 1978 and in my copending application Ser. No. 06/062,700, filed Aug. 1, 1979, for "Shelf Bracket", now U.S. Pat. No. 4,270,719 issued June 2, 1981, which reference is hereby made for a more complete description. In general, the shelf bracket 10 is formed of a non-metallic material such as wood or wood particle board or flake board and has an upper shelf supporting surface 14 and a rear abutment surface 15, and a generally L-shaped metal attaching member 12 for mounting the shelf bracket on a support surface. The L-shaped attaching member 12 has a generally horizontal upper leg **12*a* with a depending tongue 12*b* at its forward end extending downwardly into a slot 14*a* in the shelf bracket, and a generally vertical rear leg 12*c* with a tongue 12*d* at its lower end extending forwardly into a slot 15*a* in the rear portion of the shelf bracket. Protrusions 12*b*' and 12*d*" are formed on the tongues 12*b* and 12*d* respectively to engage one wall of the respective slot and press the tongues into firm engagement with the other wall of that slot to inhibit bending of the tongues relative to the respective leg and also hold the attaching member in assembled relation on the shelf bracket. The rear leg 12*c* has a keyhole shaped opening (not shown) for receiving a mounting fastener such as a screw 16, for mounting the shelf bracket on an upright supporting surface S, and the shelf bracket has a recessed area 15*b* in the upper rear corner to provide clearance for the head of the fastener 16**. The upright supporting surface S may be a finished wall and the shelf brackets are preferably positioned at locations to register with the wall supporting studs S'. Alternatively, the shelf supporting brackets can be mounted directly on studs in an unfinished room or by conventional wall mounting anchors to an upright wall at locations intermediate the wall studs.

The shelf 11 has a width somewhat greater than the length of the shelf bracket to extend to a point beyond the forward end of the shelf brackets, and a length to at least span the several shelf brackets. In accordance with the present invention, provision is made for interlocking the shelf and shelf brackets to inhibit both lengthwise and crosswise movement of the shelf relative to the shelf brackets, when the shelf is assembled on the brackets. The shelf bracket 10 has a forwardly facing abutment face 10*a* at its forward end that extends transverse to the upper shelf supporting surface 14, and the shelf bracket has a notch 10*b* formed in its upper face at a location forwardly of the attaching member 12, to provide a rearwardly facing abutment face 10*c* that also extends transverse to the upper shelf supporting surface 14. The shelf is formed of a non-metallic material such as wood particle board, flake board, or wood, and has a first lengthwise extending strip 17 attached as by a suitable adhesive, staples or the like to the underside thereof adjacent its forward edge. The strip 17 defines a first abutment strip adapted to engage the forward abutment face 10*a* on the shelf brackets. Strip 17 is preferably rigidly secured as by adhesives along its entire length to the underside of the shelf and is advantageously made sufficiently deep to function as a trim strip to cover the forward ends of the shelf brackets, and to also reinforce the forward end of the shelf. End strips 18 are also provided adjacent each end of the shelf to extend from the forward strip 17 to the rear edge of the shelf.

The second elongated abutment strip 19 is attached to the underside of the shelf generally parallel to the forward abutment strip 17, for engaging the second abutment faces 10*c* on the shelf brackets. The second abutment strip is mounted on the shelf at a location spaced from the first abutment strip 17 a distance no greater and preferably a few thousandths of an inch less than the minimum spacing between the first and second abutment faces 10*a* and 10*c* on the shelf brackets. The second abutment strip is constructed and arranged to have portions thereof that are resiliently movable relative to the shelf in a direction away from the first abutment strip 17, to resiliently clamp the first and second abutment faces 10*a* and 10*c* on the shelf brackets between the first and second abutment strips. For this purpose, the second abutment strip 19 is formed of a material for example a strip of wood or wood particle board having a sufficiently small cross section to be laterally resilient, and the strip 19 is attached to the underside of the shelf only at spaced locations such as designated 19*x* in FIG. 4, so that portions of the strip 19 intermediate the secured locations are resiliently movable relative to the shelf. The locations 19*x* are selected so as to normally lie intermediate the shelf brackets 10, when the shelf is mounted thereon. Thus, the portions of the strip 19 intermediate the secured locations 19*x*, can flex from their normal position shown in phantom lines in FIG. 4 and shift relative to the forward abutment 10*a* on the shelf brackets to a displaced position as shown in solid lines in FIG. 4 into engagement with the rearwardly facing abutments 10*c*. A cam surface 10*d* is advantageously provided on each of the shelf brackets and extends downwardly and rearwardly from the upper shelf supporting surface 14 to the second abutment face 10*c*, for camming the second abutment strip rearwardly when the shelf is assembled on the shelf bracket. The notch 10*b* in the shelf brackets for receiving the strip 19 are advantageously positioned immediately forwardly of the slots 14*a* in the shelf brackets so that the notches and the cam surface can conveniently be formed in the same machining operation with the formation of the slots 14*a* and 15*a* in the shelf bracket.

From the foregoing it is thought that the construction and operation of the device will be readily understood. The shelf brackets are first mounted on the supporting surface S by mounting fasteners 16, and the location of the shelf brackets on the wall is generally determined by the position of the wall supporting studs S'. The shelf is then positioned on the several shelf brackets with the forward abutment strip 17 engaging the front abutment face 10*a* on the shelf brackets as shown in FIG. 3, and the rear portion of the shelf then pressed downwardly. The cam surface 10*d* cam the portions of the abutment strip 19 intermediate the secured portions 19*x* rearwardly into engagement with the rearwardly facing abutment faces 10*c*. The first and second abutment strips 17 and 19 resiliently clamp the first and second abutment faces 10*a* and 10*c* on the shelf bracket therebetween and not only inhibit movement of the shelf in a direction lengthwise and crosswise thereof relative to the shelf bracket, but also inhibit vertical separation of the shelf from the shelf bracket.

The embodiments of the invention in which an exclusive property or privilege is claimed are defined as follows:

1. An interlocking shelf and shelf bracket construction comprising, at least two shelf brackets each having an upper shelf supporting surface, means for mounting the rear end of the shelf brackets on a supporting surface to extend forwardly therefrom in cantilever fashion, the shelf brackets each having a forwardly facing first abutment face extending transverse to the upper shelf supporting surface adjacent the forward end of the shelf bracket and a rearwardly facing second abutment face extending transverse to the upper shelf supporting surface at a location spaced rearwardly from the first abutment face, a shelf adapted to extend between and overlie the upper shelf support surfaces on the several shelf brackets for support thereby, the shelf having a first abutment strip extending therebelow and generally paralleling the forward edge thereof for engaging the first abutment faces on the several shelf brackets, the shelf having a second abutment strip extending therebelow and spaced from the first abutment strip a distance no greater than the minimum spacing between the first and second abutment faces on the shelf brackets, at least one of said strips being laterally resilient and attached to the shelf only at locations spaced along the shelf from the shelf brackets to allow portions of said one abutment strip intermediate the attached locations to shift relative to the other abutment strip during assembly of the shelf on the shelf brackets.

2. An interlocking shelf and shelf bracket construction according to claim 1 wherein said one abutment strip is said second abutment strip.

3. An interlocking shelf and shelf bracket construction according to claim 2 wherein said shelf brackets each have a cam surface extending downwardly and rearwardly from its upper shelf supporting surface to its second abutment face for camming the second abutment strip rearwardly when the shelf is assembled on the shelf brackets.

4. An interlocking shelf and shelf bracket according to claim 1 wherein said means for mounting each shelf bracket includes a generally L-shaped metal attaching member engageable with the respective shelf bracket at a location rearwardly of said second abutment face on the shelf bracket.

* * * * *